US006530327B2

(12) United States Patent
Hiskey et al.

(10) Patent No.: US 6,530,327 B2
(45) Date of Patent: Mar. 11, 2003

(54) METHOD AND APPARATUS FOR BURNING PYROTECHNIC COMPOSITIONS

(75) Inventors: Michael A. Hiskey, Los Alamos, NM (US); Darren L. Naud, Los Alamos, NM (US)

(73) Assignee: DMD Systems, LLC, Los Alamos, NM (US)

( * ) Notice: Subject to any disclaimer, the term of this patent is extended or adjusted under 35 U.S.C. 154(b) by 0 days.

(21) Appl. No.: 09/840,701

(22) Filed: Apr. 23, 2001

(65) Prior Publication Data

US 2002/0152912 A1 Oct. 24, 2002

(51) Int. Cl.[7] ..... F42B 4/04

(52) U.S. Cl. ..... 102/361; 102/202.7; 102/275.6; 102/336

(58) Field of Search ..... 102/202.7, 275.6, 102/285, 350, 361, 336

(56) References Cited

U.S. PATENT DOCUMENTS 3,176,618 A * 4/1965 Forsberg et al. ..... 102/284 X
3,703,080 A * 11/1972 Longwell ..... 60/219
3,943,856 A * 3/1976 Ramont et al. ..... 102/285 X
3,967,558 A * 7/1976 Brody et al. ..... 102/285
4,052,940 A * 10/1977 Gits et al. ..... 102/361
4,566,388 A * 1/1986 Loyd, Jr. ..... 102/361
4,744,299 A * 5/1988 Sayles ..... 102/290
4,754,704 A * 7/1988 Lubbers ..... 102/275.6
4,774,888 A * 10/1988 Jones et al. ..... 102/289 X
5,249,528 A * 10/1993 Lee ..... 102/361
5,610,364 A * 3/1997 Endicott, Jr. et al. ... 102/361 X
6,079,202 A * 6/2000 Cesaroni et al. ..... 102/282
6,289,815 B1 * 9/2001 Tougeron et al. ..... 102/361
6,305,286 B1 * 10/2001 Fogle, Jr. et al. ..... 102/202.7 X

* cited by examiner

*Primary Examiner*—Peter A. Nelson
(74) *Attorney, Agent, or Firm*—James C. Kennedy, III

(57) ABSTRACT

A pyrotechnic device and method for making the same is disclosed which includes a pyrotechnic composition comprising a fuel, an oxidizing agent, and at least one of a metal salt and metal powder; wherein the pyrotechnic composition further comprises a cylinder with an internal surface area positioned within an outer cylindrical surface area; and, wherein prime is proximately disposed at least at one end of the internal surface area of said cylinder.

22 Claims, 7 Drawing Sheets

Cross-Section View of Prior Art End-Burning Configuration
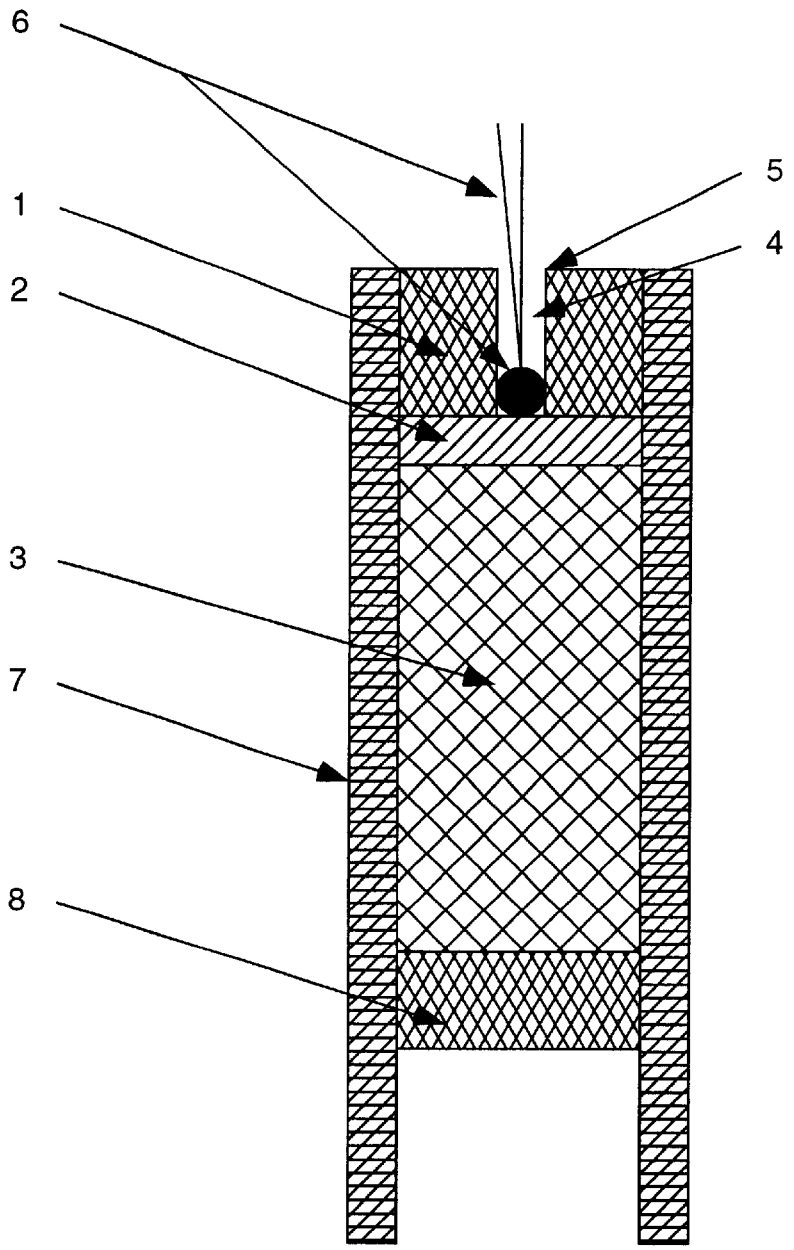
Figure 1. Prior Art End-Burning Configuration Cross-Section View of Hollow Core Grain Configuration
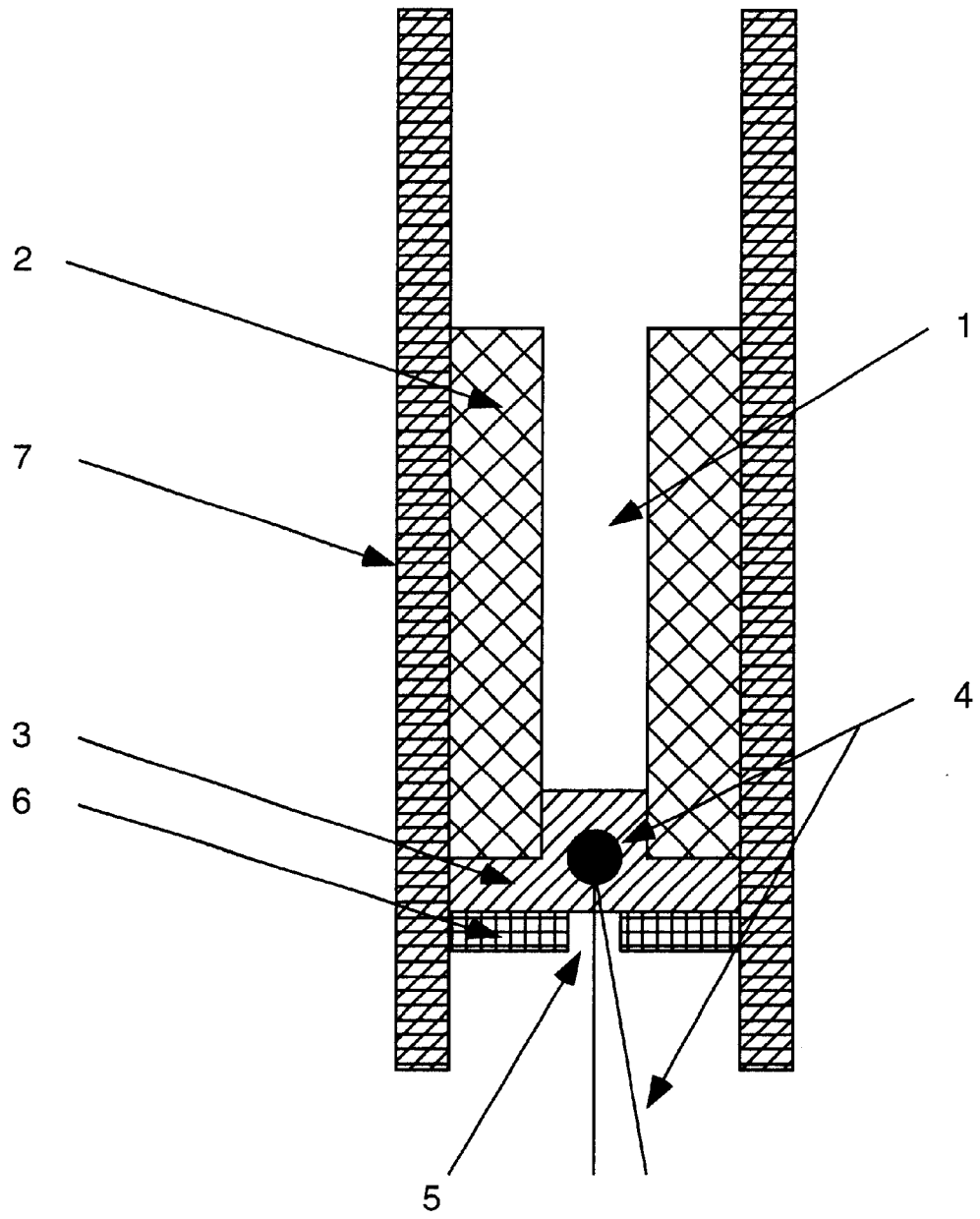
Figure 2. Hollow Core Grain Configuration

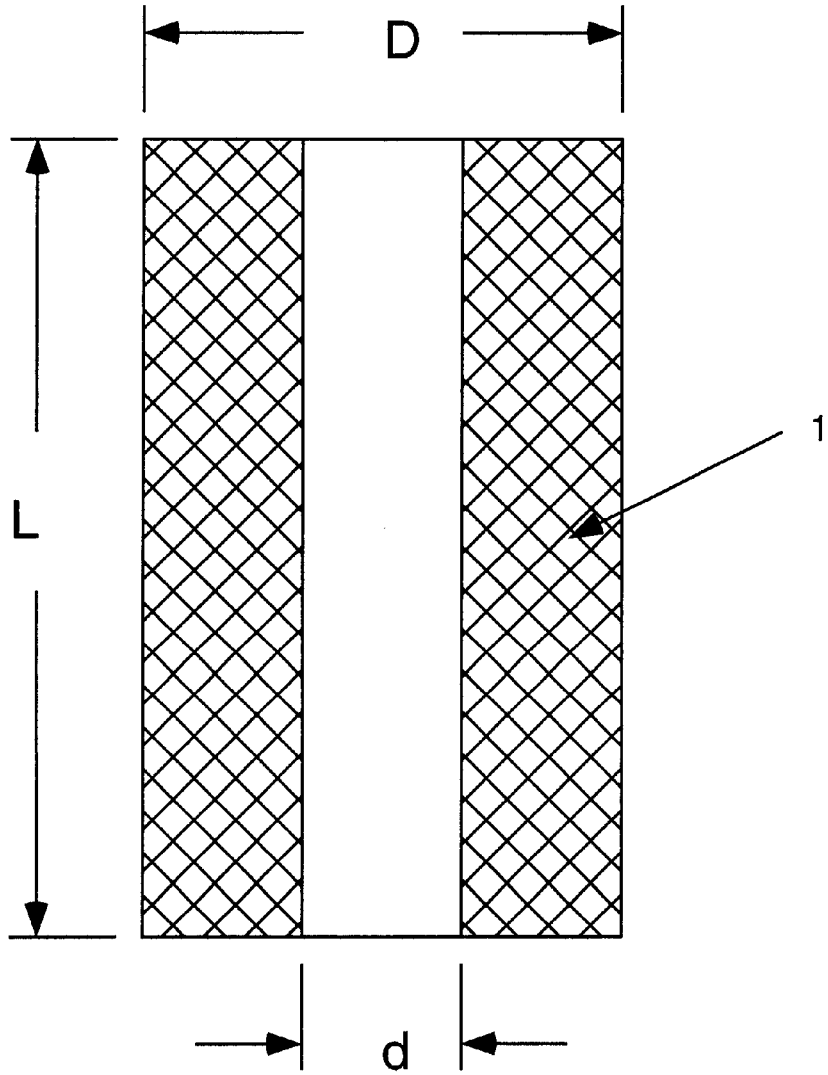
$$L = 1.5D + 0.5d$$
Figure 3. Hollow Core Cylinder (Bates Grain)

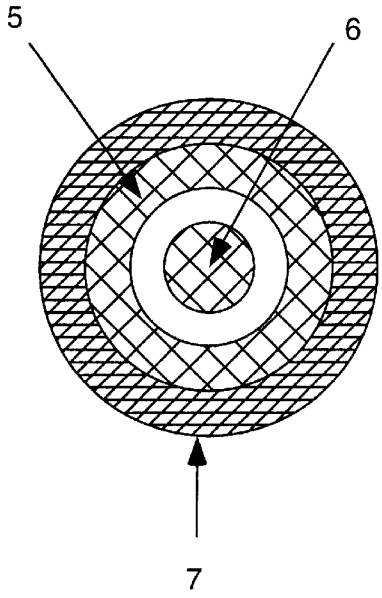
Figure 4a. Top View of Rod and Tube Configuration
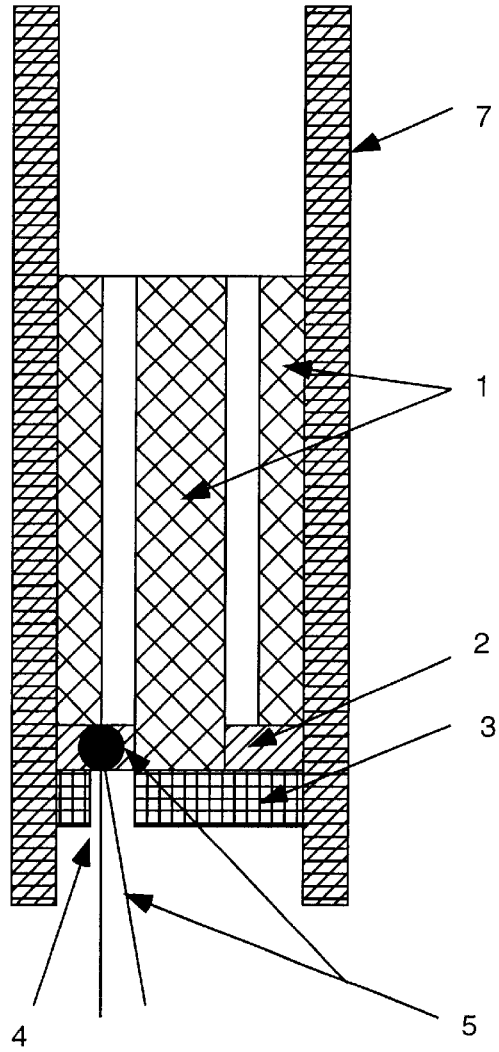
Figure 4b. Side View of Rod and Tube Configuration

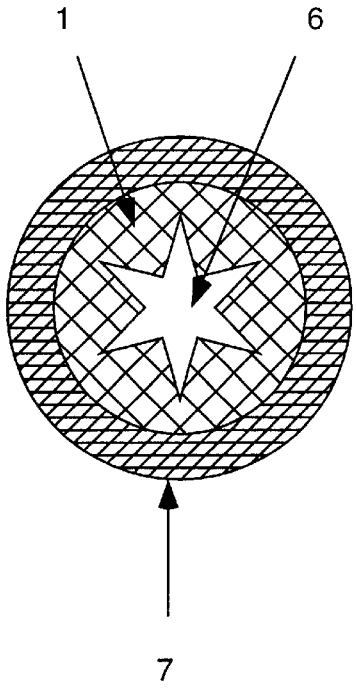
Figure 5a. Top View of Internal Star Configuration
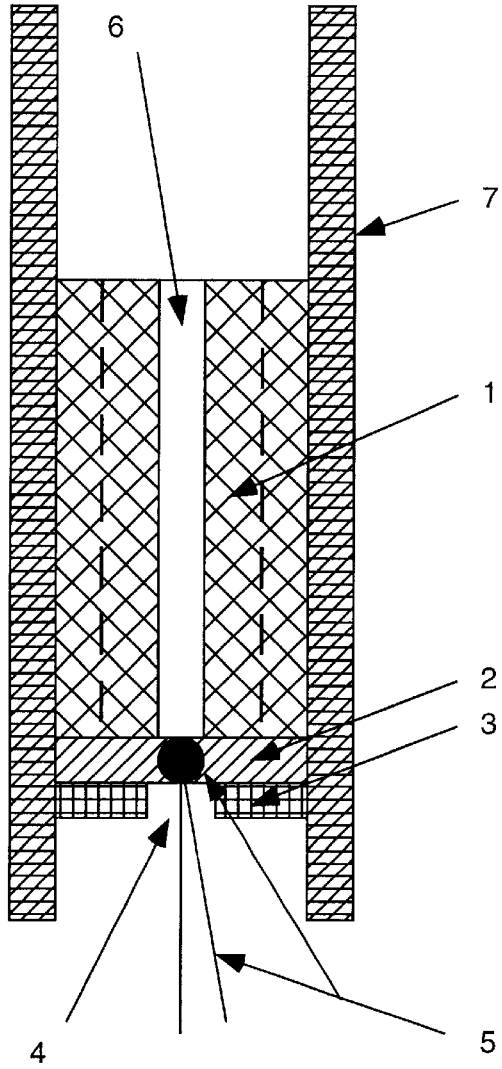
Figure 5b. Side View of Internal Star Configuration

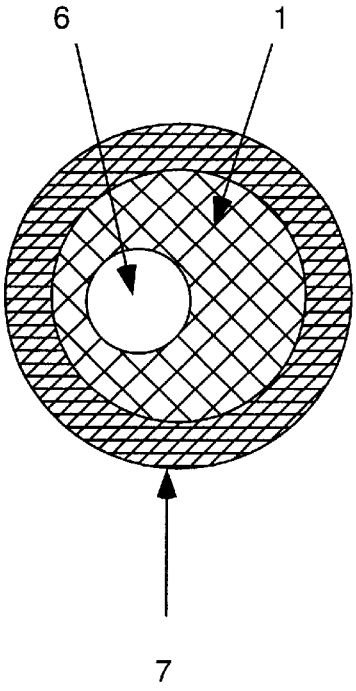
Figure 6a. Top View of Moon Burn Configuration
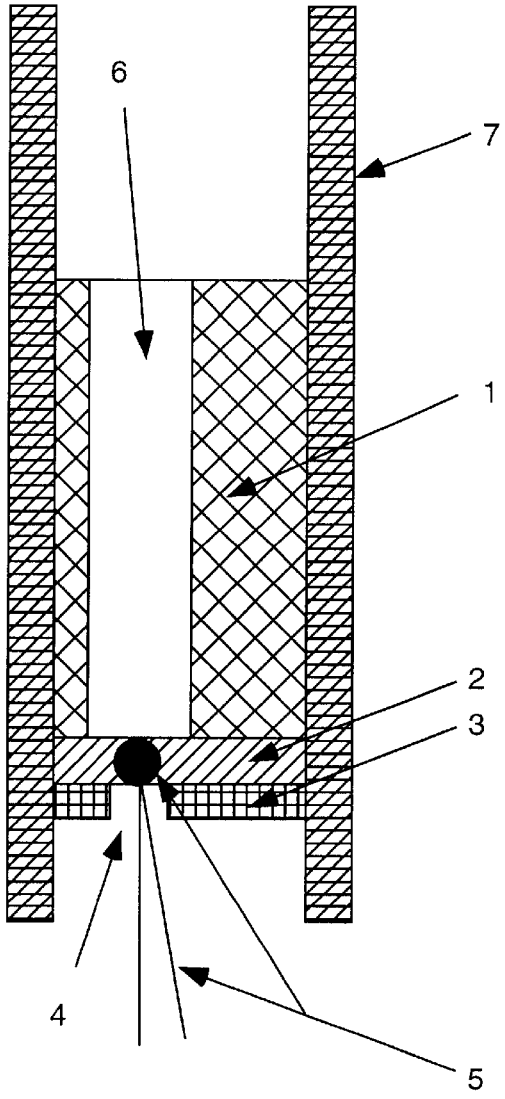
Figure 6b. Side View of Moon Burn Configuration

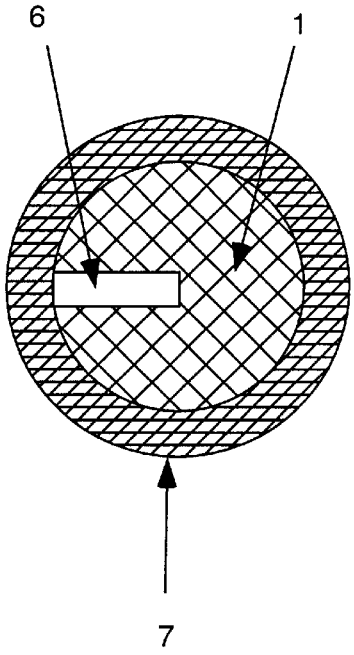
Figure 7a. Top View of C-Slot Configuration
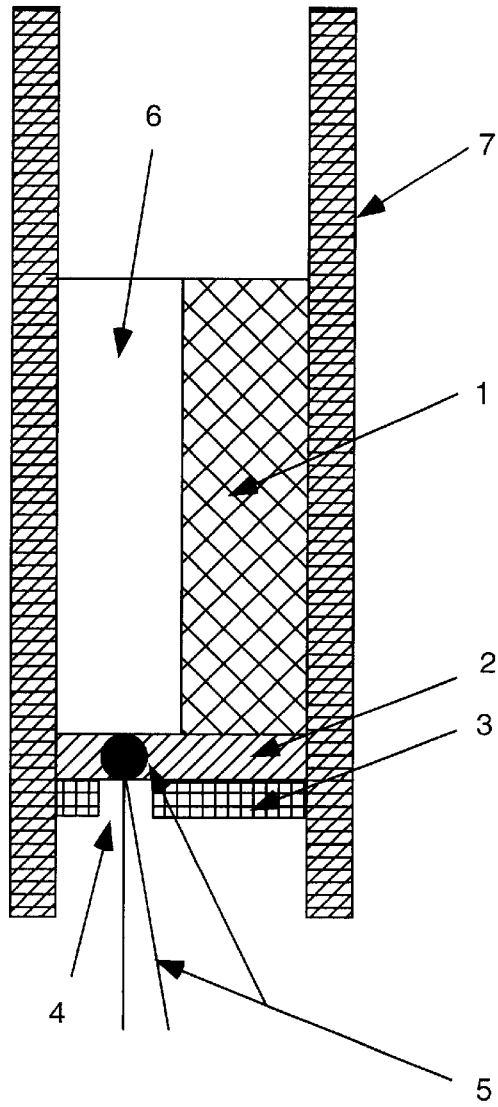
Figure 7b. Side View of C-Slot Configuration

METHOD AND APPARATUS FOR BURNING PYROTECHNIC COMPOSITIONS

FIELD OF THE INVENTION

The present invention relates to devices and methods for burning pyrotechnic compositions and more particularly to firework devices that rely on propulsion to produce colored flame displays.

BACKGROUND OF THE INVENTION

The type of pyrotechnic devices for entertainment purposes are numerous, but most generally consist of flammable compositions that burn to produce colored flames or provide propulsion for colored flames and/or sparks. Some examples are lances, which produce a colored flame only and are typically used in large sets or arrays to produce figures (e.g. flags) or letters or words. Other devices known to the pyrotechnics industry hare "flares," which produce an effect comparable to lances, but are generally larger in size. The devices called "waterfalls" burn with or without colored flames and generate a large cascade of burning metal sparks. Color-producing pellets, referred to as "stars," are employed in "shells" or "roman candles" or "star mines" and often contain stars in multiple amounts. Typically black powder is used to ignite and propel the stars out of such devices.

The devices called "gerbs" (also known as fountains) utilize pyrotechnic compositions to vertically propel burning metal sparks and in addition produce a colored flame. Among typical compositions for gerbs or fountains have been: (1) potassium nitrate, charcoal, sulfur, steel powder; or (2) potassium nitrate, strontium nitrate, potassium benzoate and titanium metal powder. Typical formulations for gerbs generally include a fast-burning fuel/oxidizer mix that contains metallic filings or powder. The metal filings or powder burns to produce various colored sparks depending on the type of metal used.

Commercial pyrotechnic devices, as for example, gerb devices, have typically used an end-burning configuration with a clay nozzle. The clay nozzle is often used to increase the pressure within the gerb device, which in turn creates the necessary pressurized gas flow to drive the burning sparks upward. A gerb is often made by pressing a clay nozzle into a cardboard tube. Subsequently, a small amount of priming mixture (prime) is pressed behind the clay nozzle followed by the pyrotechnic composition.

We have learned, however, that the end-burning configuration does not optimally produce a pyrotechnic display. Among the disadvantages presented by the present technology are that the clay nozzle restricts the size of the flame envelope and impurities such as sodium and calcium present in the clay cause flame discoloration. Further, it is difficult and impractical to remove such impurities from clay compositions. One solution has been to use larger amounts of flame colorants to overcome the flame discoloration caused by the clay impurities which in turn produces larger amounts of smoke and ash that may have detrimental environmental effects. Yet another disadvantage of the prior art is the frequency of misfiring due to the sensitivity of proper placement of an ignition source (typically done by the user) in an end-burning configuration.

As a result, a device with cleaner burning characteristics would require the use of less metallic flame colorant and consequently result in a lower smoke-producing pyrotechnic device. In addition, the efficacy of using low smoke producing pyrotechnic compositions as disclosed in related U.S. patent application Ser. No. 09/833,874 entitled "Low-Smoke Nitroguanidine and Nitrocellulose Based Pyrotechnic Compositions", which is incorporated herein by reference, would be enhanced, as lesser amounts of flame colorants are used in such low smoke producing compositions.

It is therefore an object of the invention to provide a pyrotechnic device and method that overcomes the problems presented in the prior art and allows a cleaner burning pyrotechnic device which thereby needs a lesser amount of colorants to achieve a desired pyrotechnic display. It is a further object of the invention to provide a pyrotechnic device and method whereby a faster burning device with a larger surface area of burning pyrotechnic composition may provide a more effective pyrotechnic display by increasing the propellant force characteristics of the pyrotechnic device.

It is yet another object of the invention to provide a pyrotechnic device and method that provides more reliable ignition characteristics.

It is yet another object of the invention to provide a pyrotechnic device and method whereby the rate of burn may be varied such that a variable burn rate may be advantageously used to alter visual effects in pyrotechnic displays.

SUMMARY OF THE INVENTION

To achieve the foregoing and other objects, and in accordance with the purposes of the present invention, as embodied and broadly described herein, the present invention provides a pyrotechnic composition including fuel (combustible material), an oxidizing agent, and at least one of a metal salt and metal powder, wherein the pyrotechnic composition comprises a cylinder with an internal surface area positioned within an outer cylindrical surface area; and, wherein prime is proximately disposed at least at one end of the internal surface area of said cylinder.

In another embodiment, the internal surface area and outer cylindrical surface area comprise a hollow cylinder.

In a related embodiment, the internal surface area comprises the adjacent surfaces internal to an outer cylindrical surface area formed by positioning a solid cylinder within a hollow cylinder.

In yet another embodiment, the internal surface area comprises a surface of a star-shaped opening within the cylinder extending axially to said cylinder.

In yet another embodiment, the internal surface area comprises an opening within the cylinder offset from the central axis of said cylinder extending axially through said cylinder.

In another embodiment, prime is disposed within the internal surface area said prime adjacent to an ignition source.

In another embodiment, the present invention further provides a cylindrical plug disposed adjacent to the at least one end of the hollow cylinder and including an opening in the cylindrical plug thereby allowing access to the prime.

In yet another embodiment, the present invention further provides an ignition source disposed through the opening in the cylindrical plug said ignition source adjacent to the prime.

Related embodiments of the present invention include a method of producing a pyrotechnic device according to the invention.

BRIEF DESCRIPTION OF THE DRAWINGS

FIG. 1 shows a pyrotechnic device of the prior art in an end-burning configuration.

FIG. 2 shows a hollow core grain configuration for a pyrotechnic device.

FIG. 3 shows the basic burn characteristics of a hollow core grain configuration.

FIGS. 4(*a*) and (*b*) show top and side views of a Rod and Tube pyrotechnic configuration and pyrotechnic device.

FIGS. 5(*a*) and (*b*) show top and side views of an Internal Star pyrotechnic configuration and pyrotechnic device.

FIGS. 6(*a*) and (*b*) show top and side views of a Moon Burn pyrotechnic configuration and pyrotechnic device.

FIGS. 7(*a*) and (*b*) show top and side views of a C-Slot pyrotechnic configuration and pyrotechnic device.

DETAILED DESCRIPTION OF THE PREFERRED EMBODIMENTS

The devices called "gerbs" (also known as fountains) utilize pyrotechnic compositions to vertically propel burning metal sparks and in addition produce a colored flame. Typical formulations for gerbs generally include a fast-burning fuel/oxidizer mix that contains metallic filings or powder. The metal filings or powder burn to produce various colored sparks depending on the type of metal used. The metal added to the pyrotechnic composition increases the temperature or light output of the flame and may produce a spark effect. Suitable metals include aluminum, magnesium, titanium and iron or their alloys such as magnesium/aluminum or steel. Iron powder can be generally substituted with steel powder to avoid rusting from moisture.

As shown in FIG. 1, prior art pyrotechnic devices such as gerbs have used an end-burning configuration including a clay nozzle (1), which is situated at one end of a solid cylinder pyrotechnic configuration (3). Typically the prime (2) is situated adjacent the clay nozzle (1) and in contact with an ignition source e.g., electric match (6) situated within the nozzle opening (4). The solid cylinder pyrotechnic configuration (3) is surrounded by tube housing (7) and has a clay plug (8) disposed at an end of the solid cylinder pyrotechnic configuration (3) opposite the clay nozzle (1).

We have learned, however, that the end-burning configuration does not optimally produce a colored pyrotechnic display. Among the disadvantages presented by the prior art are that the clay nozzle (1) restricts the size of the flame envelope and causes flame discoloration due to hard to remove impurities such as sodium and calcium. One solution has been to use larger amounts of flame colorants, which in turn has the undesirable effect of producing more smoke and ash that may have detrimental environmental effects. Yet another disadvantage of the prior art is the frequency of misfiring due to the sensitivity of proper placement of an ignition source (e.g., electric match) in an end-burning configuration.

In contrast to the prior art, in the present invention, a pyrotechnic device has been formulated that utilizes an internal surface area configuration. As a representative embodiment, a gerb device using a hollow cylinder (hollow core grain) configuration is shown in FIG. 2. A hollow cylinder configuration (hollow core grain) may also include what is generally known as a Bates grain and has the property that it burns inside the core as well as at the two ends. Bates grain configurations have been previously used in rocket motors. As shown in FIG. 3, in operation, the length (L) of the hollow core cylinder (1) decreases during burning while the inside diameter (d) of the hollow core cylinder (1) increases and the outer diameter (D) of the hollow core cylinder remains constant. The overall result is a steady and stable burn that burns faster and provides more propellant force for a given volume of pyrotechnic composition compared to an end-burning configuration. According to the present invention, as shown in FIG. 3, the dimensions of the hollow core cylinder are such that the length (L) is greater than or equal to 1.5(D)+0.5(d). Making the length (L) slightly greater (about 110%) than 1.5(D)+0.5(d) advantageously gives an initially more progressive (faster) burn, resulting in prompt ignition and firing of the pyrotechnic device.

According to the present invention, a gerb (fountain) does not need a nozzle to generate sufficient gas flow to drive the metal sparks upward in an acceptable flame envelope. In operation, the use of an internal surface area configuration according to the present invention, and especially a hollow cylinder configuration, is able to produce a larger colored flame envelope with the use of smaller amounts of flame colorant compared to the prior art end configuration.

Other geometries providing more pyrotechnic composition bum area and higher thrust compared to end-burning configurations may be used as well. In particular, rod and tube geometries as shown in FIGS. 4(*a*) and 4(*b*) may be advantageously used. In the rod and tube configuration the pyrotechnic device is formed by positioning a solid cylinder (6) within a hollow cylinder (5) to form adjacent burn surfaces together comprising a rod and tube cylindrical pyrotechnic composition (1). This geometry may include a cylindrical plug (3) with a plug opening (4) through which is disposed an electric match (5) which is surrounded by prime (2). Further, a tube housing (7) may be used to house the cylindrical pyrotechnic composition (1). It will be appreciated that the devices according to the present invention are manufactured with the ignition source e.g., electric match in place rather than requiring the user to install it as in prior art devices.

Other geometries that may be advantageously used in a pyrotechnic device according to the present invention to achieve variable burn rates, thus adding a degree of control over the visual characteristics of a pyrotechnic display include an internal star configuration, shown in FIGS. 5(*a*) and 5(*b*), which includes a star shaped opening (6) extending axially through cylindrical pyrotechnic composition (1) which has the property of first having a progressive burn rate (increasing burning surface area and thrust) followed by a regressive burn rate (decreasing burning surface area and thrust), and finally followed by a progressive burn rate. This geometry may likewise include a cylindrical plug (3) with a plug opening (4) through which is disposed an electric match (5) which is surrounded by prime (2). Again, a tube housing (7) may be used to house the cylindrical pyrotechnic composition (1). It will be appreciated that the prime (2) surrounding the electric match (5) may alternatively be disposed adjacent the internal surface area e.g., within the opening (6) of the pyrotechnic device configurations according to the present invention.

The Moon Burn and C-Slot configurations are shown respectively in FIGS. 6 and 7 and have the property whereby the burn initially proceeds with a progressive burn rate followed by a regressive burn rate. As with other embodiments, as shown in FIGS. 6 and 7 an electric match (5) is disposed through plug opening (4) in cylindrical plug (3) adjacent to and surrounded by prime (2) which is situated adjacent to at least one end of the cylindrical pyrotechnic composition (1). The Moon Burn configuration in FIGS. 6 (*a*) and (*b*) has a cylindrical opening (6) offset from the central axis of the cylindrical pyrotechnic composition (1). The C-Slot configuration in FIGS. 7(*a*) and (*b*) has a rectangular opening (6) offset from the central axis of the cylindrical pyrotechnic composition (1). Again a tube housing (7) may house the cylindrical pyrotechnic composition (1).

An additional advantage in using an internal surface area configuration is found in the method of firing a pyrotechnic device as explained in relation to the hollow core configuration below. It will be appreciated, however, that the concept may be applied to all of the disclosed configurations.

As shown in FIG. 1, in the prior art end burning device, an ignition source e.g., electric match (6) is inserted within the nozzle opening (4) adjacent the prime (2). In operation, when the electric match (6) is fired, the prime (2) ignites and expels the electric match (6) in an upward direction. Many times the electric match (6) is not completely dislodged and acts to disrupt the flow of sparks at the nozzle exit (5).

Another disadvantage of the prior art end burning configuration is that it has only a relatively small area of prime (2) adjacent to the nozzle opening (4) and in contact with the electric match (6) leading to a potential for ignition failure if the electric match (6) is not properly inserted (typically accomplished manually) deep inside the nozzle opening (4) adjacent the prime (2).

By contrast, in the hollow core grain configuration, as shown in FIG. 2, the electric match (4) may be disposed at one end of the hollow core (1) within the prime (3) thereby allowing more intimate contact with more surface area of the prime (3). Additionally, as shown, prime (3) and electric match (4) may be disposed within the internal surface area of the cylindrical grain (2) (hollow cylinder composition) adjacent to and surrounding an electric match (4) that is disposed through plug opening (5) of the cylindrical plug (6). A tube housing (7) may contain the cylindrical grain (2).

It will be understood that the foregoing descriptions of the preferred embodiments are intended as illustrative. Numerous modifications and variations will be immediately apparent to those skilled in the art without departing from the inventive concept.

What is claimed is:

1. A pyrotechnic device for producing a colored pyrotechnic display with increased propellant force comprising:

a pyrotechnic composition comprising a fuel, an oxidizing agent, and at least one of a metal salt and metal powder for producing sparks in a colored flame envelope;

wherein the pyrotechnic composition further comprises a cylinder with an internal surface area positioned within an outer cylindrical surface area said cylinder positioned within a housing without a nozzle such that during burning of the pyrotechnic composition the sparks and the colored flame envelope are ejected without restriction; and, wherein prime is proximately disposed at least at one end of the internal surface area of said cylinder.

2. The pyrotechnic device of claim 1, wherein the internal surface area and the outer cylindrical surface area comprise a hollow cylinder.

3. The pyrotechnic device of claim 1, wherein the internal surface area comprises adjacent surfaces internal to the outer cylindrical surface area formed by positioning a solid cylinder within a hollow cylinder.

4. The pyrotechnic device of claim 1, wherein the internal surface area comprises a surface of a star-shaped opening within the cylinder extending axially to said cylinder.

5. The pyrotechnic device of claim 1, wherein the internal surface area comprises an opening within the cylinder offset from the central axis of said cylinder extending axially through said cylinder.

6. The pyrotechnic device of claim 1, wherein prime is disposed within the internal surface area said prime adjacent to an ignition source.

7. The pyrotechnic device of claim 1, wherein the fuel comprises nitroguanidine and nitrocellulose.

8. The pyrotechnic device of claim 2, further comprising a cylindrical plug disposed adjacent to the at least one end of the hollow cylinder and including an opening in the cylindrical plug thereby allowing access to the prime.

9. The pyrotechnic device of claim 8, further comprising an ignition source disposed through the opening in the cylindrical plug said ignition source adjacent to the prime.

10. A method of producing a pyrotechnic device for producing a colored pyrotechnic display comprising the steps of:

providing a pyrotechnic composition comprising a combustible material, an oxidizing agent, and at least one of a metal salt and metal powder for producing sparks in a colored flame envelope;

forming the pyrotechnic composition into a cylinder comprising an internal surface area positioned within an outer cylindrical surface area said cylinder positioned within a housing without a nozzle such that during burning of the pyrotechnic composition the sparks and the colored flame envelope are ejected without restriction; and, disposing prime proximately to at least one end of the internal surface area.

11. The method of claim 10, wherein the step of forming the pyrotechnic composition into a cylinder with an internal surface area comprises forming a hollow cylinder.

12. The method of claim 10, wherein the step of forming the pyrotechnic composition into a cylinder with an internal surface area comprises positioning a solid cylinder within a hollow cylinder.

13. The method of claim 10, wherein the step of forming the pyrotechnic composition into a cylinder with an internal surface area comprises forming a star-shaped surface area within the cylinder extending axially to said cylinder.

14. The method of claim 10, wherein the step of forming the pyrotechnic composition into a cylinder with an internal surface area comprises forming an opening within the cylinder offset from the central axis of said cylinder extending axially through said cylinder.

15. The method of claim 10, wherein a water-soluble binder is added to the pyrotechnic composition prior to the step of forming a cylinder with an internal surface area.

16. The method of claim 15, wherein the step of forming a cylinder with an internal surface area further comprises compressing the pyrotechnic composition.

17. The method of claim 10, further comprising disposing prime within the internal surface area said prime adjacent to an ignition source.

18. The method of claim 10, wherein the combustible material comprises nitroguanidine and nitrocellulose.

19. The method of claim 10, further comprising disposing a cylindrical plug adjacent to the at least one end of the hollow cylinder and including an opening in the cylindrical plug thereby allowing access to the prime.

20. The method of claim 19, further comprising disposing an ignition source through the opening in the cylindrical plug said ignition source adjacent to the prime.

21. The pyrotechnic device of claim 2, wherein the dimensions of the hollow cylinder are such that the length of the hollow cylinder is greater than or equal to about 1.5 times the diameter of the hollow cylinder added to about 0.5 times the diameter of the hollow portion of the hollow cylinder.

22. The pyrotechnic device of claim 5, wherein the opening comprises a rectangular shaped opening.

* * * * *